United States Patent [19]

Auer

[11] Patent Number: 4,528,053

[45] **Date of Patent: * Jul. 9, 1985**

[54] MANUFACTURING FIBERBOARD DUCTS

[76] Inventor: Mark J. Auer, 23520 Lake Rd., Bay Village, Ohio 44140

[ * ] Notice: The portion of the term of this patent subsequent to Jul. 24, 2001 has been disclaimed.

[21] Appl. No.: 628,640

[22] Filed: Jul. 6, 1984

Related U.S. Application Data

[63] Continuation-in-part of Ser. No. 428,147, Sep. 29, 1982, Pat. No. 4,461,664.

[51] Int. Cl.[3] ..... B31F 1/00; B31F 7/00

[52] U.S. Cl. ..... 156/204; 156/468; 156/498; 226/196; 229/16 R; 493/52; 493/78; 493/179

[58] Field of Search ..... 156/64, 204, 378, 468, 156/498, 292; 226/196; 229/16 R; 493/52, 73, 78, 179, 182, 287, 297

[56] References Cited

U.S. PATENT DOCUMENTS

| | | | |
|---|---|---|---|
| 3,242,780 | 3/1966 | Ried et al. | 409/304 |
| 3,420,142 | 1/1969 | Gale et al. | 409/304 |
| 3,534,646 | 10/1970 | Tyer | 409/304 |
| 3,605,534 | 9/1971 | Barr | 409/304 |
| 3,829,338 | 8/1974 | Hayasi et al. | 156/64 |
| 3,850,775 | 11/1974 | Bruneau et al. | 156/468 |
| 3,908,526 | 9/1975 | Vas Salos | 493/297 |
| 4,045,263 | 8/1977 | Moore et al. | 156/64 |
| 4,070,954 | 1/1978 | Cailey | 493/287 |
| 4,337,113 | 6/1982 | Searle | 156/498 |

*Primary Examiner*—Jay H. Woo
*Assistant Examiner*—Timothy W. Heitbrink
*Attorney, Agent, or Firm*—Thomas M. Schmitz

[57] ABSTRACT

The apparatus forms fiberboard hollow ducts from fiberboard and comprises means for collapsing or partially collapsing the fiberboard into a flat collapsed fiberboard or partially collapsed fiberboard for advancing the collapsed or partially collapsed fiberboard through a preheating and heating stage while heat sensitive tape is applied to the linear seam of the advancing fiberboard. After tape is applied, means for applying pressure and cooling operate to permanently set the tape.

23 Claims, 14 Drawing Figures

MANUFACTURING FIBERBOARD DUCTS

BACKGROUND OF THE INVENTION

This is a continuation-in-part of copending application Ser. No. 428,147 filed Sept. 29, 1982, now being U.S. Pat. No. 4,461,664, and the same is incorporated herein by reference.

This invention pertains to the manufacture of fiberboard ducts for use as insulating conduit for transmitting hot or cold gases, and more particularly to an apparatus and method of forming flat fiberboard into individual hollow duct units.

Linear fiberboard duct is produced from a wide variety of fibrous boards which are formed into hollow duct units having a square or rectangular through-put cross section. Several duct units are secured end to end to provide a continuous run of duct work such as shown in U.S. Pat. Nos. 3,242,780; 3,420,142; 3,534,646; and 3,605,534. Duct forming apparatus shown in these patents as well as in U.S. Pat. No. 4,070,954 comprise flat fiberboard folded into a rectangular cross section while passing through a plurality of elongated rollers arranged in an off-set parallelogram. The fiberboard is formed into a hollow duct whereby the duct seam is closed and secured with tape. The cross section of the duct can be changed by adjusting the elongated rollers inwardly or outwardly to accommodate larger or smaller cross-sectional duct units. Similarly, U.S. Pat. No. 3,908,526 suggests the formation of fiberboard tubes by coacting pairs of rollers adapted to maintain a hollow tube during the forming process. The prior art processes, however, require exact spacing of the peripheral rollers to maintain the fiberboard in the form of a parallelogram while securing the linear seam of the holow duct. Thus, prior art processes necessitate maintaining the fiberboard in perfect parallelogram alignment during the formation of each hollow duct unit.

It now has been found that hollow fiberboard duct can be manufactured by holding the fiberboard flat or partially collapsed with an upwardly exposed linear seam between the distal ends of the fiberboard, whereby the linear seam engages a depending permanent guide means adapted to maintain the adjacent wall members in butting position while the seam is permanently secured with tape. The centrally disposed permanent guide means avoids adjustments for different cross-sectional ducts and avoids maintaining hollow parallelogram alignment during the forming process. In accordance with this invention, flattened or partially collapsed fiberboard is conveyed while the linear abutting edges of the fiberboard duct engages the guide means, which quickly and automatically aligns the adjacently disposed fiberboard wall members into butting position and is maintained in juxtaposition while the linear seam is stapled and sealed. Upon completely securing the linear seam, the flattened or partially collapsed duct can be removed and stacked for shipping or expanded for use as hollow duct. The centrally disposed guide means permits accommodating of various size fiberboards, without cumbersome adjustments to accommodate variable size cross sections, and further avoids the need for accurate adjustment of pairs of rollers to maintain proper parallelogram alignment. This and other advantages will become more apparent by referring to the drawings and the detailed description of the invention.

SUMMARY OF THE INVENTION

Briefly, the apparatus of this invention comprises means for forming fiberboard duct from grooved fiberboard containing grooved sections comprising two intermediate center sections and two outer end sections. The grooved fiberboard is conveyed to the apparatus in a flattened or partially collapsed condition where the two outer end sections are collapsed downwardly onto the intermediate sections and the distal linear edges engage a centrally disposed linear guide means. The guide means functions to align and maintain in alignment any size fiberboard by aligning the distal linear edges of outer end sections of the fiberboard to form a linear seam connection for the subsequent step of securing the adjacently disposed linear edges and provide a secured seam between opposed outer linear edges of the two outer fiberboard sections. The centrally disposed guide means maintains the collapsed or partially collapsed fiberboard sections in close abutment and properly aligned while the fiberboard enters the linear seam securing step wherein the seam is taped or otherwise permanently secured. Upon emerging from the apparatus, the duct can be expanded to form a finished hollow fiberboard duct unit.

IN THE DRAWINGS

DETAILED DESCRIPTION OF THE INVENTION

Figure 1:
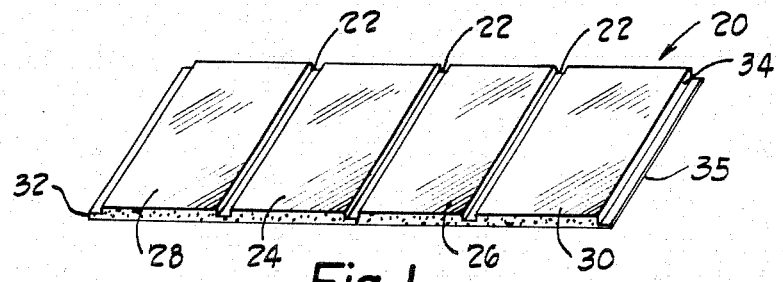
FIG. 1 is a perspective view of a length of grooved fiberboard prior to fabrication into a linear duct.
Figure 2:
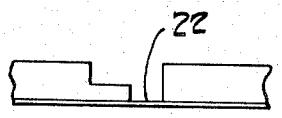
FIG. 2 is an enlarged end view of one of the grooves in the fiberboard shown in FIG. 1.
Figure 3:
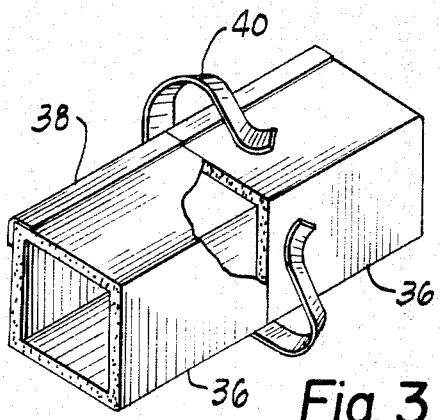
FIG. 3 is a perspective view of fiberboard ducts formed from grooved fiberboards in FIG. 1 and secured together to form linear duct work.

Referring to the Drawings wherein like characters designate like parts, shown in FIG. 1 is a grooved fiberboard 20 containing three linear grooves 22 separating two intermediate or interior sections 24, 26 from outer end section 28, 30 having distal outer edges 32, 34. FIG. 2 shows an enlarged side elevation view of one of the linear grooves 22. FIG. 3 shows the fiberboard 20 folded inwardly at the grooves 22 to form two finished hollow duct units 36 having distal linear edges 32, 34 secured with structural tape 38, whereby the two duct units 36 can be secured together end to end by peripherally applied structural tape 40 to form duct work. The fiberboard material can be any fibrous board and desirably includes impervious facing material on the outside surface and sometimes on both inner and outer surfaces such as Owen Corning "Fiberglas" duct board. The facing material can be aluminum foil or hard plastic sheeting such as vinyl plastic material.

Figure 5:
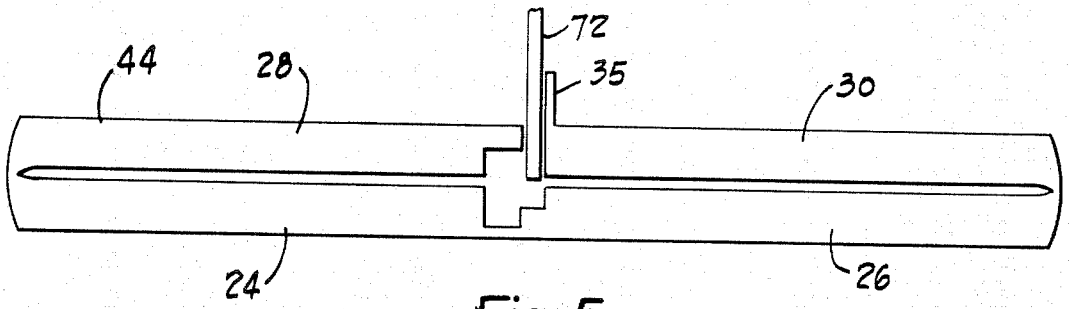
FIG. 5 is shows an end view of the collapsed fiberboard engaging the overhead guide means shown in FIG. 4.
Figure 6:
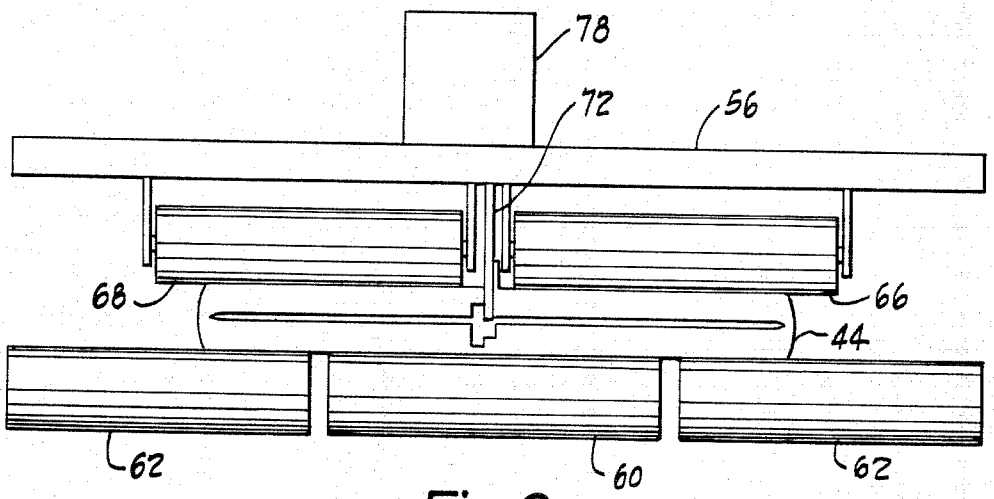
FIG. 6 is a sectional view taken along lines 6—6 in FIG. 4.
Figure 4:
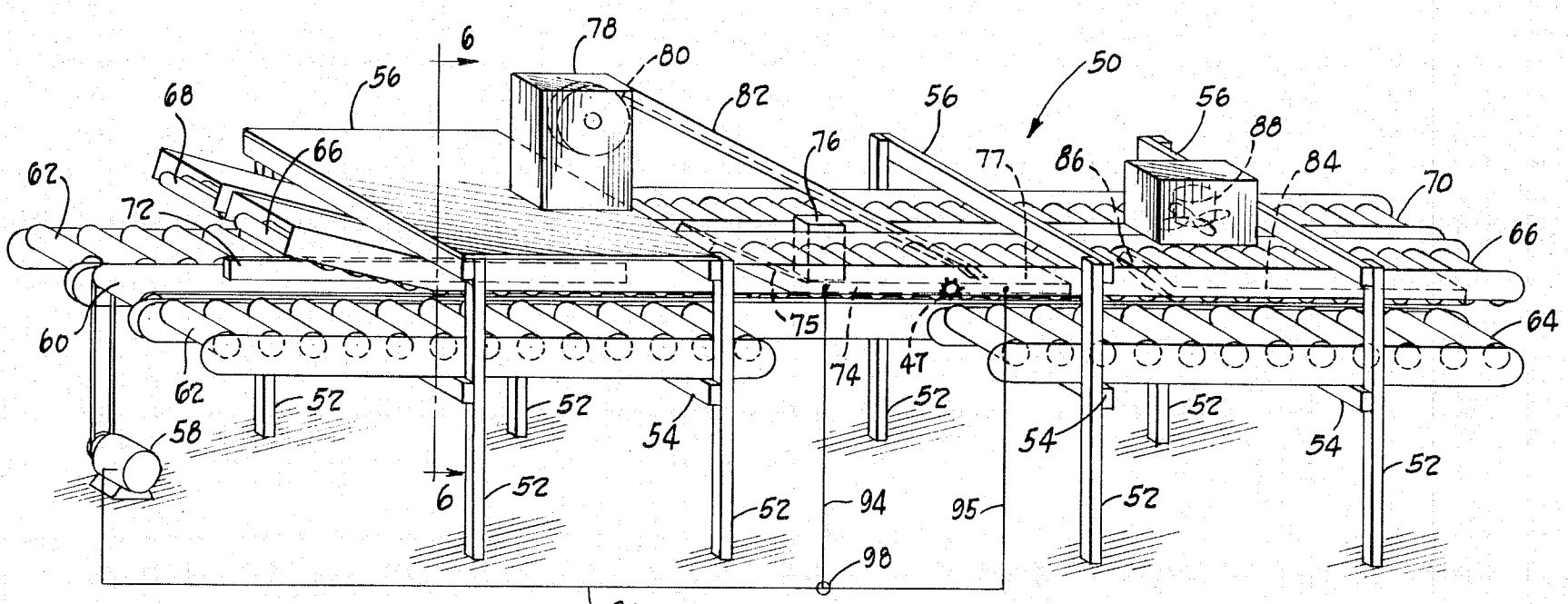
FIG. 4 is a perspective view of the apparatus of this invention adapted to convey folded fiberboard of FIG. 1 collapsed together to engage a guide means while the linear seam of the fiberboard is secured in accordance with this invention.
Figure 7:
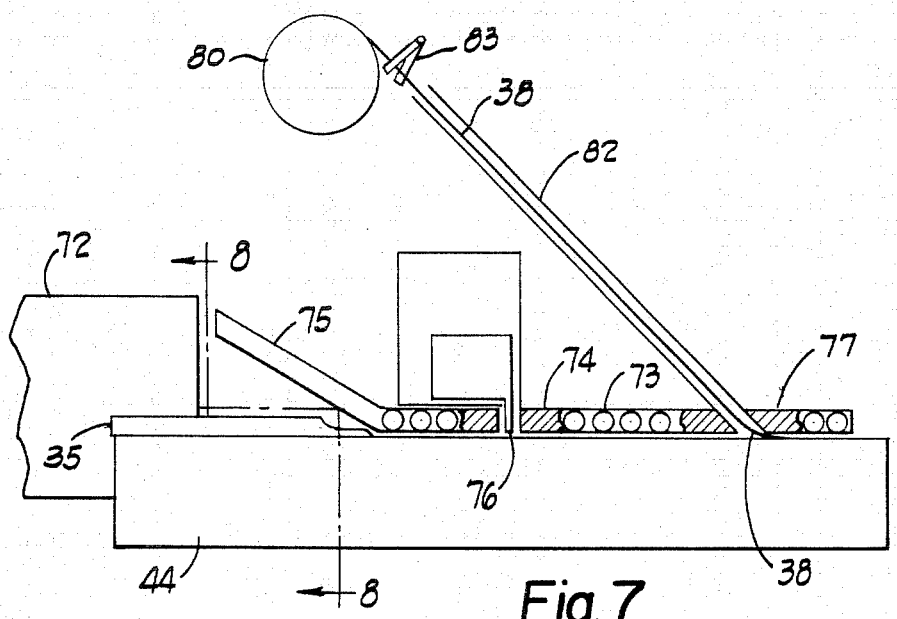
FIG. 7 is a partial side view of the apparatus in FIG. 4 particularly showing the collapsed fiberboard entering stapling and taping steps to secure the linear seam of the collapsed duct.
Figure 8:
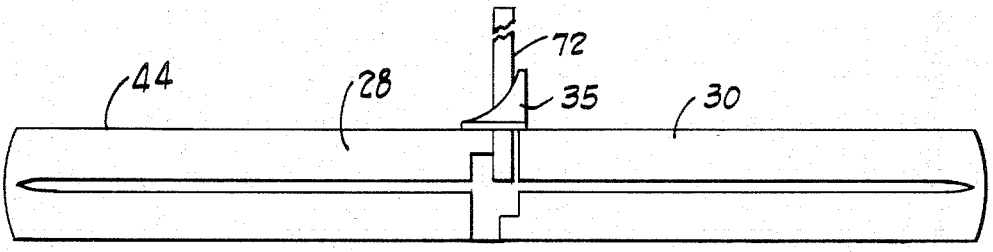
FIG. 8 is a partial sectional view taken along lines 8—8 in FIG. 7.
Figure 9:
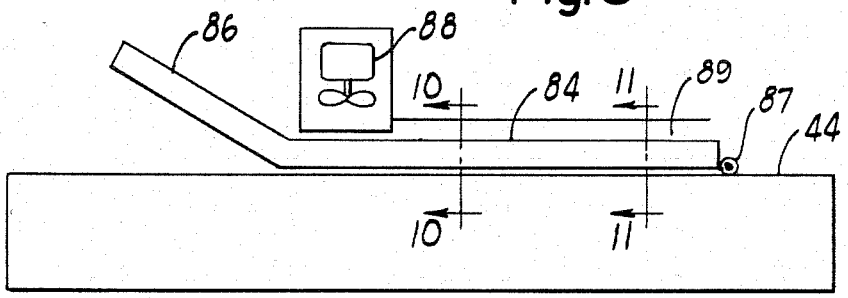
FIG. 9 is a partial side view of the apparatus in FIG. 4 particularly showing the collapsed fiberboard entering an ironing and cooling step after emerging from the taping step.

Referring to FIG. 4, shown generally is an apparatus 50 adapted to secure linear structural tape 38 onto folded fiberboards 20 in accordance with this invention. The various parts of apparatus 50 are supported by structural steel framework comprising vertical posts or legs 52, lowr horizontal frame members 54, and overhead frame members 56. A lower conveyor means is operatively supported upon the lower horizontal frame 54 and preferably comprises a steel wire central drive belt conveyor 60 along with a pair of side free wheeling skate roller conveyors 62 on either side of belt conveyor 60. The central drive conveyor 60 is operative by motor drive means 58 and extends the length of the apparatus 50, whereas the free wheeling side conveyors can be either a single conveyor or include rearward conveyor 62 and forward conveyor 64. Supported by the upper frame 56 is an upper conveyance means comprising a continuous upper roller conveyor 66 on one side and spaced laterally from an upper rearward roller conveyor 68 and upper forward conveyor 70 on the other side. The rearward portion of conveyors 66 and 68 are angled upwardly to assist in collapsing the fiberboard 20 upon entering the apparatus 50. The collapsed fiberboard 44 is shown in FIG. 5 wherein end sections 28, 30 are bent inwardly and downwardly on top of interior sections 24, 26.

In accordance with this embodiment of the invention, a depending overhead linear guide means 72 secured to upper frame 56 is disposed between upper conveyor 66 and rearward upper conveyor 68, whereby the linear guide means 72 is adapted to engage the linear distal edges 32, 34 when the fiberboard 20 is collapsed together to form the collapsed fiberboard 44. Fiberboard 20 further includes a securing flap 35 extending from distal end 34 whereby the flap 35 is directed vertically upward while the collapsed fiberboard 44 engages the guide means 72. The elongated guide means 72 terminates linearly short of and spaced from an elongated horizontally disposed heating means 77 secured to overhead frame 56. The heating means 77 includes a rearwardly disposed upwardly directed extension member 75 adapted to force the upwardly disposed flap 35 downwardly into flat engagement with adjacent fiberboard end section 28. The flap 35 remains extended upwardly while passing the guide means 72 but is forced flat upon engaging the upward directed member 75 and then becomes heated by the heating iron means 77 containing heating elements 73. The heating means 77 preferably comprises a preheat portion 74 linearly adjacent to member 75 for preheating the flap 35. The primary heating portion 77 provides post heating after the tape 38 has been applied to the collapsed fiberboard 44. The flap 35 overlaps fiberboard end section 28 and is secured thereto by a stapling means 76 secured to overhead frame 56 and operative to secure staples into flap 35 and end section 28 through an opening in the heating means 74, whereby the fiberboard distal edges 32, 34 are secured together in a laterally spaced relationship while still being guided by the guide means 72. Thus, the flap 35 is secured while being preheated prior to engaging structural tape 38 being dispensed from an overhead tape disperser 78 supported on top of the overhead frame 56. The structural tape 38 is heat sensitive tape and adapted to preferably thermoset upon heat curing by heating means 77 which preferably is tilted slightly downward toward the terminating forward end to assure combined pressing and heating of the tape 38. Both the preheater 77 and the primary heater 74 contain heat sensing means 94 and 95 respectively interconnected to electrical relay switch 98 adapted to interrupt and stop the drive motor 58 in the event the preheater or the primary heater 77 malfunctions by overheating or by losing heat. Surface temperature of the primary heater is typically above 400° F. and sufficient to cure the heat sensitive tape 38. The tape 38 is activated by roller switch means 47 adapted to activate tape 38 and dispense from a tape roll 80 through a downwardly depending track 82 extending through an opening in the heating means 77 to engage the preheated top surface of flap 35, whereby tape 38 secures flap 35 and adjacent fiberboard end section 28. The track 82 preferably is an insulated track. A cutting means 83 by the tape dispenser 78 is operative to precut the tape 38 to predetermined lengths automatically dispensed for application to the collapsed fiberboard 44.

Figure 10:
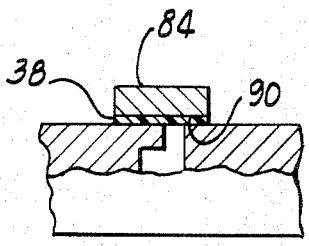
FIG. 10 is a partial sectional view taken along lines 10—10 in FIG. 9.
Figure 11:
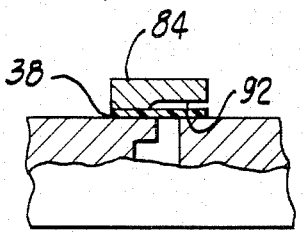
FIG. 11 is a partial sectional view taken along lines 11—11 in FIG. 9.

The heating means 77 terminates linearly short of a forwardly disposed horizontal cooling shoe 84 having a rearward upward bevel 86. The cooling shoe 84 is supported by overhead frame 56 and can contain an external cooling fan 88 disposed above the cooling shoe 84 and secured to the overhead frame 56 and preferably is interconnected to a cooling tunnel 89 disposed above shoe 84. The cooling shoe 84 functions to withdraw heat from the tape 38 thereby permanently setting the adhesive and securing the adjacently disposed fiberboard end sections 28, 30. As shown in FIGS. 10 and 11, the cooling shoe 84 contains a generally flat bottom surface 90 at the intermediate portion of cooling shoe 84 and a contoured uneven bottom surface 92 on one side as viewed in FIG. 11 which assures preferentially applied pressure overall the tape 38. In like manner, the heating means 77 can include a heating surface comprising a flat surface and an uneven contoured surface as illustrated in FIGS. 10 and 11. The heating means 77 and cooling shoe 84 can be combined into one unit provided the heating means 77 and cooling shoe 84 units are separated by insulating material such as ceramic. The Termination point of cooling means 84 includes a pair of wheels 87 on the cooling shoe 84. Upon emerging from the apparatus 50, the collapsed fiberboard 44 can be expanded to form a finished hollow duct 36 as shown in FIG. 3.

Figure 12:
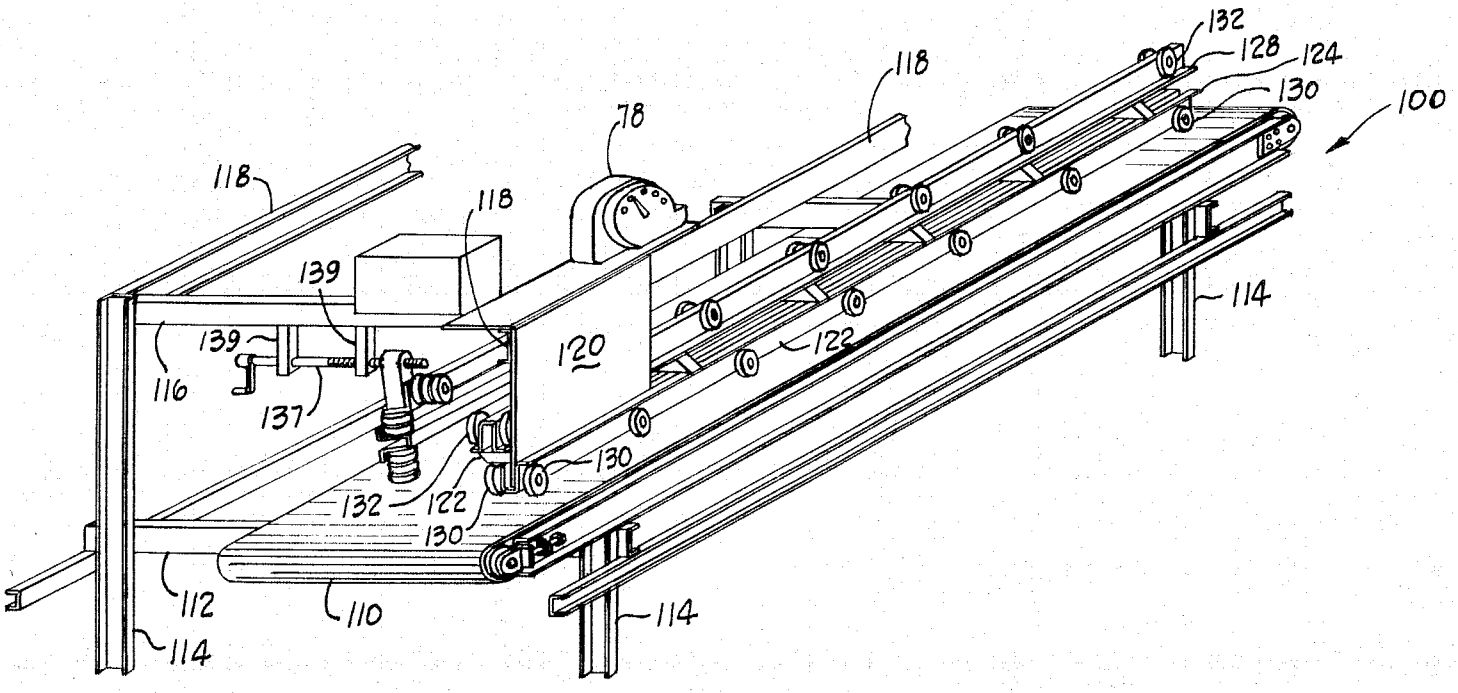
FIG. 12 is a rear perspective view of a further embodiment of the apparatus of this invention.
Figure 13:
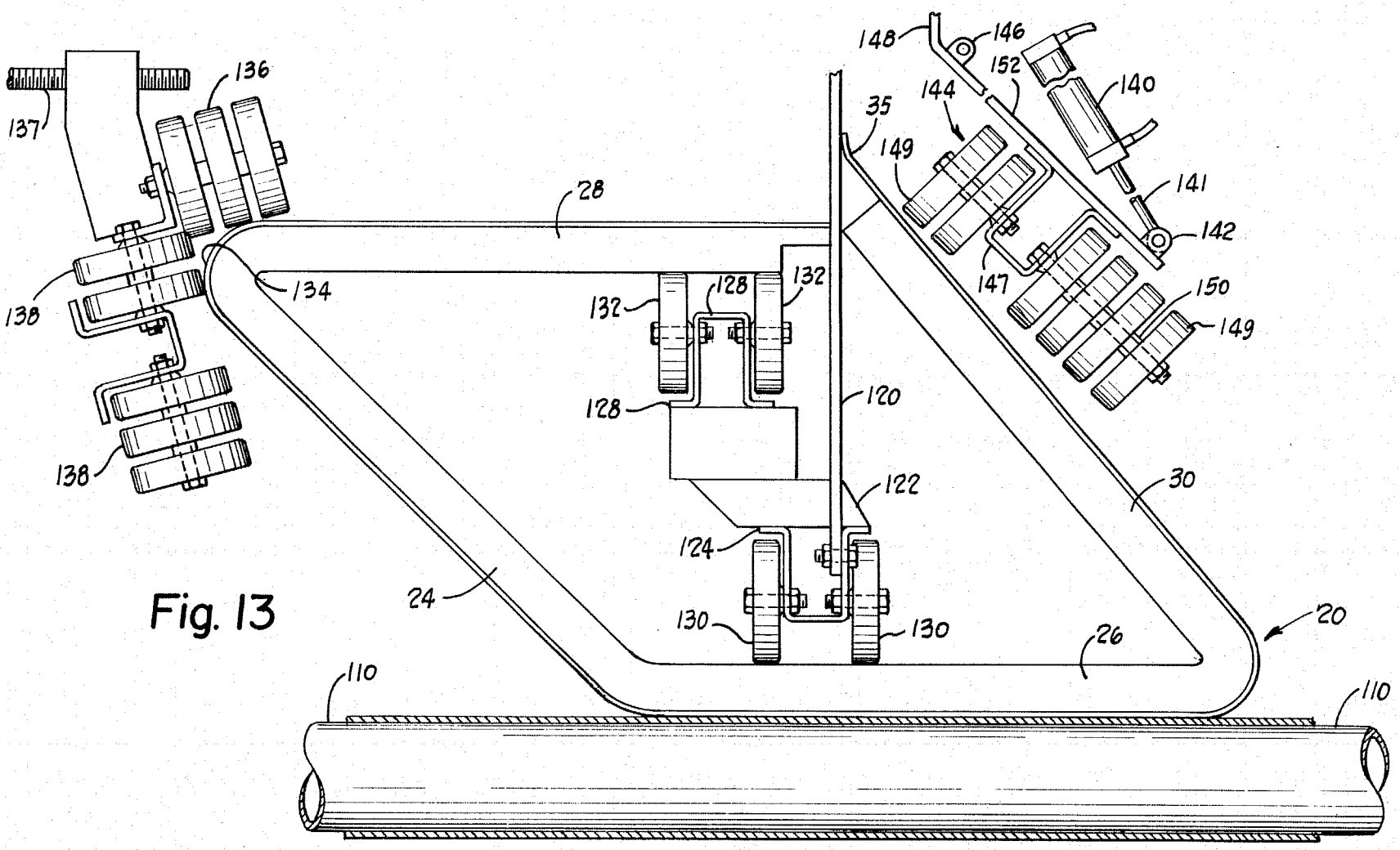
FIG. 13 is an enlarged rear elevation view of partially collapsed fiberboard passing through the apparatus of FIG. 12.
Figure 14:
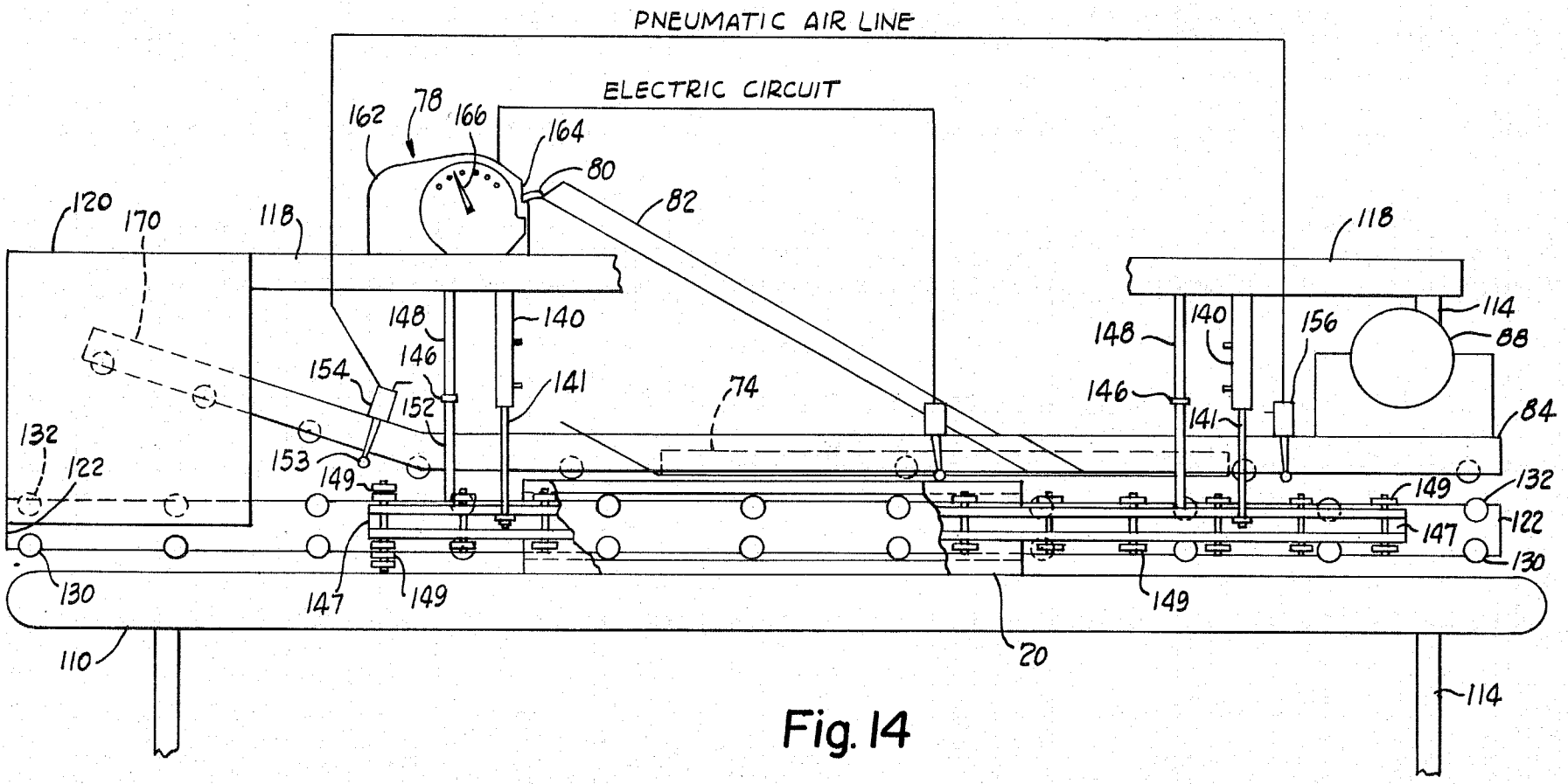
FIG. 14 is a side elevation view of the apparatus in FIG. 12.

Referring now to the further embodiment of the apparatus shown in FIGS. 12–14, an apparatus 100 is drawn with some parts removed to better illustrate equivalent elements of this embodiment of the invention. In a manner similar to the apparatus 50 shown in FIG. 4, the apparatus 100 in FIG. 12 comprises a lower drive conveyor 110 operatively supported by spaced lower cross frame members 112, vertical posts 114, lateral overhead frame members 116 and linear overhead frame members 118. In accordance with this embodiment of the invention, a downwardly depending overhead linear guide means 120 is welded or otherwise secured to a linearly directed overhead frame member 118 whereby the lower edge portion of the downwardly depending guide means is disposed just above the conveyor means 110 with sufficient space for a thickness of fiberboard duct 20 to engage both the conveyor 110 and the guide means 120 as hereinafter described. The lowermost portion of the linear guide mean 120 includes a linearly extended catilevered beam 122 extending substantially the linear length of the apparatus 100. The linear beam 122 contains a lower downwardly depending channel 124 and an upwardly directed structural channel member 128. The lower channel 124 includes a plurality of operatively interconnected lower pairs of wheels 130 spaced linearly along the lower channel 124 and adapted to ride on the surface of a thickness 26 of fiberboard 20 passing between the lower wheels 130 and the drive conveyor 110. In a similar manner, the upwardly extending channel member 128 contains a plurality of upper wheel pairs 132 spaced linearly along the upper channel 128 and adapted to support a section 28 of partially collapsed fiberboard 20, as hereinafter described.

As best viewed in FIG. 13, fiberboard 20 comprising intermediate sections 24, 26 and outer end sections 28, 30 is partially collapsed in an offset trapazoidal cross-section whereby the left outer end section 28 is supported by the plurality of upper wheels 132 operatively connected to the upper channel member 128 of the catilevered beam 122. Similarly, the plurality of lower wheel pairs 130 engage the intermediate section 26 of the fiberboard 20. The fiberboard duct distorted accute edge 134 between fiberboard outer end section 28 and intermediate section 24 engages an upper roller alignment means comprising an upper roller means 136 and side roller means 138 comprising engaging wheels extending linearly forward substantially the linear length of the apparatus 100. The upper alignment means is secured to bearing support channels 139 engaging a threaded rod 137 where said bearing support channels are secured to the overhead lateral frame member 116, whereby the threaded rod 137 can be turned by handle 141 to laterally adjust the upper alignment means to properly engage the acute edge 134 and adjacent sections 28, 24 of the duct 20. The upper alignment means can extend the entire length or a partial linear length of the apparatus 100. The upper roller means 136 effectively forces the outer fiberboard section 28 against the upper roller pairs 132 in use whereas the side roller means 144 maintains the outer alignment of the fiberboard relative to the linearly extended guide means 120.

The other outer end section 30 of the duct 20 engages a pivotally adjustable roller engaging means 144 comprising a plurality of wheels 149 operatively connected to linear channel 147 adapted to engage the exterior of the duct end section 30 whereby the partially collapsed fiberboard is maintained in square alignment with the centrally disposed linear guide means 120. The pivotally operative roller means 144 is pivotally connected at 146 to a bracket 148 welded or otherwise secured to the overhead frame 118. Bearing rods 150 supporting the wheels 146 are secured to a linear support member 152. The roller engaging means 144 likewise extends the linear length of the apparatus 100. The pivotal movement of the roller means 144 is guided by a pneumatic air cylinder 140 containing a plunger 141 pivotally connected to support member 152 at pivot means 142. The air cylinder is secured to the overhead frame 118. The roller means 144 is adapted to normally extend laterally outward away from the apparatus 110 but operative to pivot downward and engage the outer surface of the duct end section 30. The pivotal movement of the pivotally adjustable roller engaging means 144 is automatically operative in response to a compressed air activating system interconnected to activating switches. In this regard, a rearward switch 154 is activated by the forward leading edge of the partially collapsed fiberboard 20 passing through the apparatus 100 whereby a depending member 153 of the switch 154 disrupts the compressed air system. The pivotally adjustable roller means 144 previously maintained in an outwardly extended position by the compressed air system drops pivotally downward upon activation of the switch 154 and interruption of the compressed air system. A second forward switch 156 is similarly operatively interconnected to the same compressed air system and is forwardly displaced and adapted to be engaged by the foreward leading edge of the partially collapsed fiberboard advancing through the apparatus 110 whereby the second switch 156 maintains an open or disrupted air system after the rearward edge of the collapsed fiberboard 20 passes the first switch 152. After the fiberboard passes through the apparatus 100, the second switch 156 becomes free of the fiberboard 20 and again closes the pneumatic air system whereby the compressed air system becomes a closed system and causes the pivotally adjustable linearly directed roller means to pivot upwardly and away from the path of the fiberboard until a new fiberboard 20 engages the first switch 154 causing the roller means 144 to again pivot downwardly to engage the outer end section 30 of the fiberboard 20 in the manner just previously described.

In a manner similar to FIG. 4, the apparatus 100 can be equipped with an upper rearward conveyor means 170 extending forewardly into a linear continuous conveyor means 170 adapted with wheels to engage the outer end section 28 of the fiberboard 20 and maintain the fiberboard partially collapsed in further engagement with the upper wheel pairs 132 of the centrally disposed linear guide means 120. The apparatus in FIGS. 12–14 further contains a preheating means 74, a stapling means 76, a heating means 77, a cooling shoe 84, a cooling fan 88, and a tape dispensing means 78 as illustrated in FIGS. 1–11. The heating means 77 and cooling means 84 can be combined into one shoe where the heating means 77 is separated from the cooling means 84 by insulating ceramic. The tape dispensing means 78 in FIGS. 12–14 comprises a housing 162 containing a roll of tape 80 being dispensed through a slit opening 164. The length of tape 38 to be dispensed can be predetermined by an adjustable crank 166 to provide the length of tape necessary to tape the length of fiberboard to be taped. The tape is cut by an internal cutting means 83 to the predetermined length whereupon the lead edge of the tape 38 emerges from the housing 162 ready to tape the next fiberboard 20 seam. The tape means is activated by a roller switch 47 or a trip switch 168 engage by the advancing fiberboard 20 whereby an electrical circuit or mechanical relay activates the tape dispenser 78. Accordingly, strip length tapes 38 are dispensed automatically in response to advancing fiberboard 20 whereupon predetermined lengths of tape 38 descends down the track 82 and subsequently is applied to the fiberboard in accordance with this invention.

In accordance with the process of this invention, grooved fiberboard 20 is folded inwardly whereby the end sections 28, 30 are folded downwardly onto the intermediate sections 24, 26 whereupon the folded fiberboard 44 is conveyed forwardly into the apparatus 50. The folded fiberboard 44 first engages the upwardly angled portions of the upper roller conveyor 66, 68 whereby the folded fiberboard 44 is collapsed tightly against the lower conveyors 60, 62 upon entering the apparatus 50, as shown in FIGS. 1–11. The collapsed fiberboard 44 has distal edges 32, 34 spaced laterally apart to engage either side of the depending guide means 72 which aligns the collapsed fiberboard 44 and maintains the distal edges 32, 34 essentially parallel during the process for securing the fiberboard flap 35 to the upper surface of end section 28. The flap 35 is first extended upwardly by the guide means 72 until the collapsed board 44 engages the rearwardly disposed upwardly directed extension member 75 of the heating means 77 which forces the flap 35 downward to rest flat against the upper surface of the end section 28. In a similar manner, the partially collapsed fiberboard passing through the apparatus 100 shown in FIGS. 12–14 engages the linear guide means 120 where the plurality of lower wheel pairs 130 operatively connected to the cantilevered beam 122 ride on the internal fiberboard section 26 and the plurality of upper wheel pairs 132 support the overhead fiberboard end section 28 while the distal edges 32, 34 engage opposite sides of the centrally disposed linear guide means 120. The depending guide means 120 aligns the partially collapsed fiberboard passing through the apparatus 100 and maintains the distal edges 32, 34 essentially parallel during the process for securing the fiberboard flap to the upper surface of the end section 28. The flap 35 is first extended upwardly by the guide means 120 until the partially collapsed fiberboard engages the rearwardly disposed upwardly directed extension member 75 which forces the flap 35 downward to rest flat against the upper surface of the end section 28. In both embodiments shown in FIGS. 1–11 and in FIGS. 12–14, the foreward moving collapsed or partially collapsed fiberboard 44 causes the flattened flap 35 to engage the upper surface of the preheat portion 74 of heating means 77, where the flap can be stapled if desired while being preheated, and then engages heat sensitive tape 38 being dispensed through an opening within the heating means 77. The forward end portion of the heating means 74 applies pressure to the applied tape 35 causing a secure bond between the tape 38 and the flap 35 as well as the adjacent top surface of the opposed edge 32 of fiberboard end section 28. Thereafter, the collapsed fiberboard 44 enters the cooling zone where the cooling shoe 84 further applies pressure and cools the tape 38 to permanently set the adhesive and secure the linear seam of the collapsed fiberboard duct 44. The collapsed fiberboard 44 emerges forwardly from the exit end of the apparatus 50 in a collapsed condition which can be either stored as a collapsed fiberboard 44 or expanded to form a hollow duct 36.

The apparatus of this invention provides a very efficient method and apparatus for securing the linear seam on fiberboard duct by utilizing a permanently secured overhead guide means whereby various size ducts can be easily fabricated without carefully controlled adjustments. Fiberboard is easily collapsed and conveyed forwardly in abutting engagement with the guide means which maintains parallel alignment of juxtapositioned edges during the process for securing the linear seam. Fiberglass duct can be automatically formed and sealed through the use of pressure and temperature control to provide a secure positive sealing of the duct joint or seam. The partially collapsed duct can be internally supported during the taping process while tape is fed automatically from a tape dispenser down a track to and through an opening in the heating shoe where the tape is applied to the preheated duct. The tape can be cut at predetermined lengths such as 48 inches for four foot ducts. The apparatus is substantially adjustment free but can be adjusted to accommodate various size partially collapsed ducts.

Although the foregoing illustrates preferred embodiments of this invention, variations are contemplated, and the foregoing is not intended to be limiting except by the appended claims.

I claim:

1. An apparatus for fabricating a flat fiberboard duct made from a flat fiberboard having a plurality of linear sections comprising two intermediate sections and two outer end sections which terminate laterally with linear edges adapted to be secured together to form a linear seam, the first outer end section having a linear flap adjacent to the first outer end section linear edge and adapted to overlap the linear seam and be secured to the second outer end section adjacent to the second outer end section linear edge to form a folded fiberboard duct, the apparatus comprising:

a supporting frame;

drive conveyor means supported by said frame adapted to collapse said flat fiberboard into a collapsed fiberboard and advance the collapsed fiberboard through the apparatus from the rear entrance to the forward exit of the apparatus;

a linear guide means supported by said supporting frame overhead said drive conveyor at the entrance portion of said apparatus where said guide means is adapted to engage and maintain square the first outer end section linear distal edge and the second outer end section distal edge and to bend said flap upwardly while said conveyor advances the collapsed fiberboard forwardly through said apparatus, whereby said guide means maintains square alignment of the collapsed fiberboard with said linear guide means at the entrance portion of the apparatus, said linear guide means terminating forwardly of the entrance portion of the apparatus;

flattening means supported by said frame and disposed forwardly adjacent to the termination of said guide means, said flattening means adapted to engage the upwardly directed flap of the advancing collapsed fiberboard and flatten the flap onto the second outer end section of the collapsed fiberboard;

preheat means supported by said frame and disposed forwardly adjacent to flattening means for preheating the flap of said collapsed fiberboard duct while advancing through the apparatus;

tape dispensing means supported by said frame adapted to dispense a predetermined length of heat sensitive tape to be applied in a taping area located forward of said preheating means to secure the preheated flap and second outer end section of the collapsed fiberboard, whereby the tape secures the linear seam of the collapsed fiberboard;

heating iron means supported by said frame and disposed forwardly of said taping area, said heating iron adapted to heat the tape and provide applied pressure to the heated tape whereby the heated tape adheres to the flap and second outer end section of the collapsed fiberboard; and cooling means supported by said frame and disposed forwardly of said heating means, said cooling means adapted to cool the heated tape and secure the linear seam of the collapsed fiberboard, whereby the collapsed fiberboard can be removed from the exit portion of the apparatus.

2. The apparatus in claim 1 wherein the entrance portion of the drive conveyor includes upwardly directed overhead conveyor means supported by said frame and extending downwardly toward the drive conveyor and adapted to compress the folded fiberboard into a collapsed fiberboard upon advancing forwardly into the apparatus.

3. The apparatus of claim 1 wherein a stapling means supported by the frame is operative to staple the flap to the second outer end section of the collapsed fiberboard.

4. The apparatus of claim 1 wherein the preheating means and the heating means comprises a flat heating surface having a hole between the preheat means and the heating means, said hole comprising the taping area.

5. The apparatus of claim 4 wherein the flat heating surface includes an upwardly extending rear member comprising said flattening means.

6. The apparatus in claim 4 wherein the heating surface is tilted slightly downward in the forward portion and adapted to provide increasing applied pressure to the forwardly advancing collapsed fiberboard.

7. The apparatus in claim 1 wherein the cooling means comprises a cooling surface and a cooling circulating air means directing air against the cooling means.

8. The apparatus in claim 7 wherein the cooling means includes a wind tunnel above the cooling surface and communicating with said cooling circulating air means whereby cool air is directed over said cooling surface.

9. The apparatus in claim 7 wherein the cooling surface includes an alternative flat surface and contour surface adapted to apply preferential applied pressure to the tape applied to the flap side alternate with second outer end section side of the collapsed fiberboard.

10. The apparatus in claim 7 wherein the heating means includes a heating surface includes an alternate flat surface and contour surface adapted to apply preferential applied pressure to the tape applied to the flap side alternate with second outer end section side of the collapsed fiberboard.

11. The apparatus in claim 7 wherein the forwardly disposed termination point of the cooling surface includes a wheel means adapted to provide rolling motion to the existing collapsed fiberboard and avoid snagging on the cooling surface upon exiting from the apparatus.

12. The apparatus of claim 1 including temperature control means for the preheat means and operative to stop the drive conveyor upon overheating or loss of heat in the preheat means.

13. The apparatus in claim 1 including temperature control means for the heating means operative to stop the drive conveyor upon overheating or loss of heat in the heating means.

14. The apparatus in claim 1 wherein the tape dispending means includes a heat insulated track for guiding the heat sensitive tape to the taping area.

15. The apparatus in claim 1 wherein the drive conveyor means comprises a steel wire belt.

16. An apparatus for fabricating a flat fiberboard duct from a flat fiberboard having a plurality of linear sections comprising two intermediate sections and two outer end sections which terminate laterally with linear edges adapted to be secured together to form a linear seam, the first outer end section having a linear flap adjacent to the first outer end section linear edge and adapted to overlap the linear seam and be secured to the second outer end section adjacent to the second outer end section linear edge to form a fiberboard duct, the apparatus comprising:

a supporting frame;

drive conveyor means supported by said frame where said frame is adapted to advance partially collapsed flat folded fiberboard through the apparatus from the rear entrance to the forward exit of the apparatus;

a linear guide means supported by said supporting frame overhead said drive conveyor at the entrance portion of said apparatus where said linear guide means is adapted to engage and maintain in square alignment the first outer end section linear distal edge and the second outer end section distal edge and to bend said flap upwardly while said conveyor advances the partially collapsed fiberboard forwardly through apparatus, said linear guide means comprising a forwardly disposed linear catilevered member containing a plurality of lower roller means and a plurality of upper roller means, the lower roller means operative to ride on the interior surface of one of the intermediate fiberboard sections and the upper roller means operative to support the fiberboard second outer end section while the partially collapsed fiberboard is passing through the apparatus, whereby said guide means maintains square alignment of the partially collapsed fiberboard;

flattening means supported by said frame and disposed forwardly of the rear entrance of the apparatus, said flattening means adapted to engage the upwardly directed flap of the advancing partially collapsed fiberboard and flatten the flap onto the second end section of the collapsed fiberboard;

preheat means supported by said frame and disposed forwardly adjacent to said flattening means for preheating the flap of said partially collapsed fiberboard duct while advancing through the apparatus;

tape dispensing means supported by said frame adapted to dispense a predetermined length of heat sensitive tape to be applied in a taping area located forward of said preheating means to secure the preheated flap and second outer end section of the partially collapsed fiberboard, whereby the tape secures the linear seam of the partially collapsed fiberboard;

heating iron means supported by said frame and disposed forwardly of said taping area, said heating iron adapted to heat the tape whereby the heated tape adheres to the flap and the second outer end section of the partially collapsed fiberboard; and cooling means supported by said frame and disposed forwardly of said heating means, said cooling means adapted to cool the heated tape and secure the linear seam of the partially collapsed fiberboard, whereby the partially collapsed fiberboard can be removed from the exit portion of the apparatus.

17. The apparatus of claim 16 wherein said catilevered member of the linear guide means extends substantially the length of the apparatus and contains spaced pairs of lower roller and spaced pairs of upper rollers.

18. The apparatus in claim 17 including roller engaging means adapted to engage the outer surface of the fiberboard first outer end section to maintain pressure against the fiberboard first outer end section and maintain in square alignment with said linear guide means.

19. The apparatus in claim 18 where said roller engaging means is pivotally mounted to said frame whereby said roller engaging means is operative to pivot downwardly to engage the fiberboard first end section upon the fiberboard advancing through the apparatus.

20. The apparatus in claim 19 including switch means interconnected to means operative to pivotally lower said roller engaging means downwardly.

21. The apparatus in claim 16 including an alignment means supported by said frame wherein said alignment means comprises a plurality of roller means adapted to engage the acute edge portion formed by the second outer end section and adjacent to the intermediate section of the partially collapsed fiberboard.

22. The apparatus in claim 21 wherein the alignment means is laterally adjustable.

23. In a process for fabricating a fiberboard duct from a fiberboard having a plurality of linear sections comprising two intermediate sections and two outer end sections which terminate laterally with linear edges adapted to be secured together to form a linear seam, the first outer section having a linear flap adjacent to the first outer end section linear edge and adapted to overlap the linear seam and be secured to the second outer end section adjacent to the second outer end section linear edge to form a fiberboard duct, the process steps comprising:

folding the fiberboard wherein the first outer end section and second outer end section meet to provide a folded fiberboard duct having the distal linear edges of the first and second outer end section form a linear seam;

advancing the folded fiberboard duct and aligning the linear seam with a centrally disposed downwardly depending linear guide means supported overhead for advancing the folded fiberboard where each distal linear edge of the outer end sections engage the linear guide means to maintain the folded fiberboard in square alignment with the linear guide means;

partially collapsing the folded fiberboard between converging conveying means to form a partially collapsed fiberboard duct while maintaining the partially collapsed fiberboard duct in alignment with said linear guide means;

preheating the seam of the partially collapsed fiberboard duct while maintaining alignment with said linear guide means;

applying heat sensitive tape to the seam of said partially collapsed fiberboard duct while maintaining alignment with said linear guide means;

heating and pressing the heat sensitive tape to secure the tape whereby the tape secures the fiberboard flap to the second outer end section;

cooling the heated tape to set the while removing the partially collapsed fiberboard duct.

* * * * *